United States Patent [19]

Fogel

[11] 4,152,796

[45] May 8, 1979

[54] WATERBED MATTRESS

[75] Inventor: Isaac Fogel, Silver Spring, Md.

[73] Assignee: Classic Products Corporation, Beltsville, Md.

[21] Appl. No.: 890,993

[22] Filed: Mar. 28, 1978

[51] Int. Cl.[2] ..... A47C 27/08

[52] U.S. Cl. ..... 5/451; 5/457

[58] Field of Search ..... 137/574; 220/22; 5/370, 5/371, 349, 350

[56] References Cited

U.S. PATENT DOCUMENTS

| | | | |
|---|---|---|---|
| 3,732,585 | 5/1973 | Krehbiel | 5/370 |
| 3,736,604 | 6/1973 | Carson, Jr. | 5/366 |
| 3,840,921 | 10/1974 | Habianco | 5/349 |

*Primary Examiner*—Casmir A. Nunberg
*Attorney, Agent, or Firm*—Anne M. Kornbau

[57] ABSTRACT

A waterbed mattress construction includes a plurality of water wave action dampening baffles which extend the vertical distance between the bottom and top interior surfaces of the mattress. The dampening baffles comprise flexible plastic strips welded to the interior bottom surface of the mattress, and floatation rods welded in a sleeve at the other end of the baffles. The baffles are so positioned within the waterbed mattress to provide lengthwise and diagonal dampeners which interfere with any water wave action.

11 Claims, 3 Drawing Figures

WATERBED MATTRESS

BACKGROUND OF THE INVENTION

The present invention relates to a waterbed mattress and, more particularly, to a waterbed mattress which has internal vertical baffles for reducing water wave action within the mattress.

Although waterbeds of various constructions have become extremely popular in recent years, many individuals have purchased waterbeds and have been dissatisfied with them. The water mattress, which is basically a non-form retaining bag filled to capacity with water, exhibits a resonant frequency phenomenon related to the size of the bag and the mass of the water. Many individuals find this resonant characteristic disruptive of sleep or other pursuits.

A waterbed mattress is supported on four sides. With the advent of waterbeds, a special frame structure was developed to support a water-filled mattress. Generally, the most commonly used structure includes a platform or pedestal which raises the height of the mattress to the level of a conventional bed. The pedestal may be of any structural design. Usually, commercial pedestals are somewhat smaller in dimensions than the mattress and the supporting frame. The waterbed frame, therefore, may extend beyond the pedestal as much as a foot on all four sides. The waterbed frame includes a decking board, which rests on the pedestal, and an upstanding frame structure that includes rails. A waterbed mattress is supported on the decking board and within the upstanding frame. The pedestal and frame combination provides a basic unit which can be used for contemporary or traditional decor.

The most widely accepted mattress size is the queen size which measures 60×80 inches. A queen size waterbed mattress which is 9 inches deep will hold approximately 187 gallons of water. A person lying on a waterbed mattress which holds that much water will create a transverse wave action each time he shifts his body weight. Once the water is set into motion, a resonant frequency develops which strikes the sides of the supporting frame of the bed and returns in the opposite direction. Any continuous movement will cause a larger resonant frequency which would require several minutes to dissipate.

In prior waterbed mattresses, there have been attempts to alleviate the problem of resonant frequencies created from water wave action. One of the most common solutions is to reduce the thickness or height of the waterbed mattress and cushioning it with foam pads. Tinnel, U.S. Pat. No. 4,015,299, is directed to such a waterbed construction. Even though the Tinnel construction is intended to reduce resonant frequencies, it is highly likely that there will be a substantial amount of resonant frequency. Furthermore, the Tinnel construction requires the use of a substantial amount of foam padding which increases the cost of the mattress.

Labianco, U.S. Pat. No. 3,840,921, provides a waterbed mattress construction with a pair of parallel internal baffles which are joined with the interior top and bottom surfaces of the mattress. Each baffle for a major portion of the length of the mattress, and thereby forms separate parallel chambers within the mattress. The ends of the chambers are in intercommunication adjacent to the ends of the mattress. This baffle arrangement allows water in the mattress to swirl from one chamber to the next. While the use of baffles is superior to other solutions for reducing water wave action and the inherent resonant frequency associated therewith, the fact remains that baffles arranged parallel to each other with intercommunication at each end of the mattress will not arrest the wave action in a short period of time. The swirling water at each end of the mattress does not dampen the wave action. In fact, the transverse wave action in combination with the swirling water creates stresses on the baffles where they are joined to the interior top and bottom surfaces. Quite often these stresses result in pulling the baffles loose from the mattress, thereby destroying the dampening affect. The Labianco baffle arrangement is intended to be used with a waterbed frame having inclined walls such that some of the wave action bulges the mattress over the end of the frame to take up some of the resonant frequency, which is entirely different from the present invention which uses a regular waterbed frame without inclined walls.

Carson, et al., U.S. Pat. No. 3,736,604, discloses a waterbed mattress which includes baffles suspended from the interior top surface. The baffles are bottom weighted to resist the water wave action. The baffles also have holes to provide a restricted communication between the chambers formed by the baffles. The baffles run lengthwise and crosswise, with the crosswise baffles spaced between the lengthwise baffles. The Carson, et al. baffle arrangement sets up relatively stationary walls across the mattress since the crosswise baffles interfere with any movement of the lengthwise baffles. The baffles being weighted and suspended from the top interior surface of the mattress and having communication holes are limited in maintaining a smooth wiping action with the bottom interior surface which is important in dampening any wave action in a short period of time.

SUMMARY OF THE INVENTION

It is an object of the present invention to provide a waterbed mattress which overcomes objectionable water wave action commonly associated with waterbeds.

It is a further object of the present invention to provide a waterbed mattress with a baffle dampener arrangement which reduces the resonant frequency of a wave by one-third or better.

It is still another object of this invention to provide a waterbed mattress which can be used with a waterbed frame having upright rails and still dampen any water wave action.

According to the invention, there is provided a waterbed mattress which includes a top sheet and a bottom sheet with a plurality of baffle dampeners attached to the interior of the bottom sheet and extending vertically to contact the interior of the top sheet. The baffle dampeners are arranged to have at least some lengthwise and some diagonal baffle dampeners to dampen the water wave action at least one-third.

Figure 1:
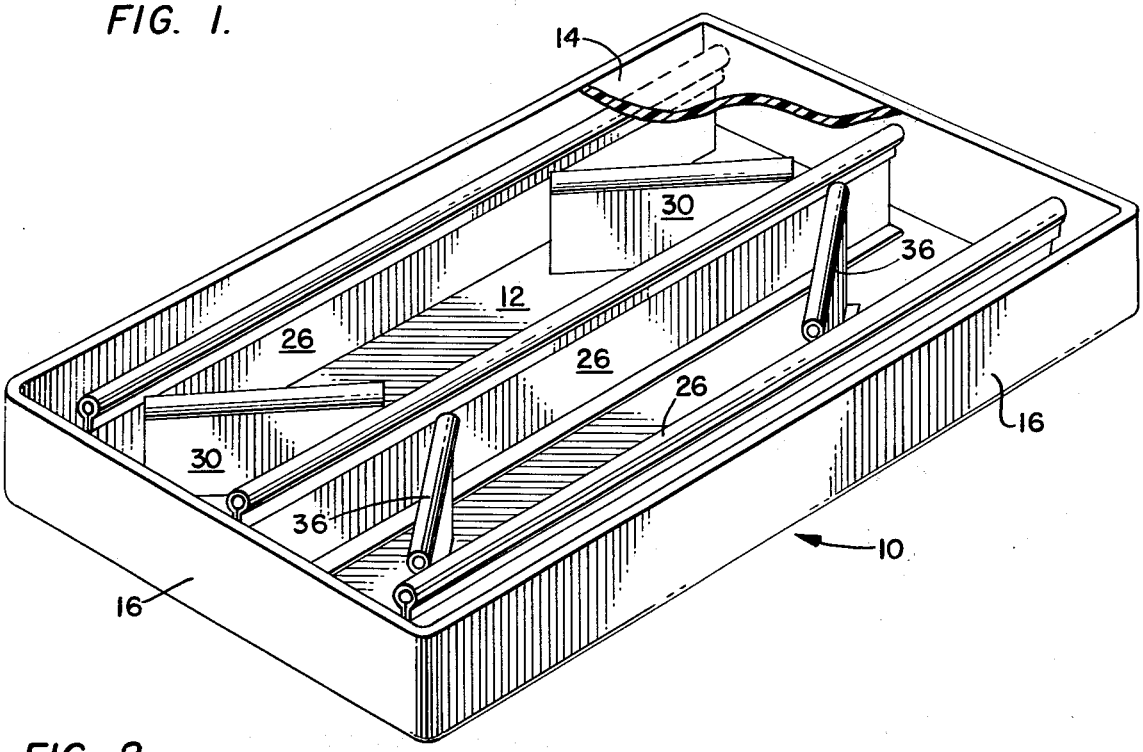
FIG. 1 is a perspective view of a waterbed mattress of the invention.
Figure 3:
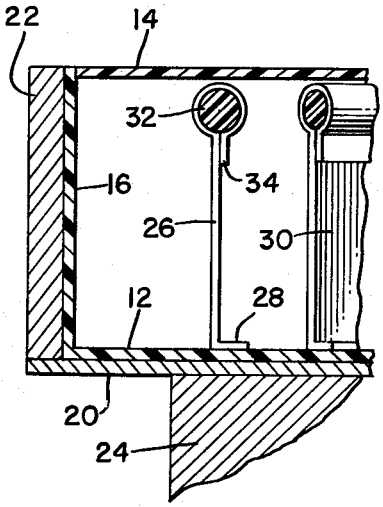
FIG. 3 is a sectional view taken along the line 3—3 of FIG. 1 showing the baffle dampener of the invention.

Referring to the drawings and, in particular, to FIG. 1, there is shown a waterbed mattress of the present invention which includes a sturdy rectangular waterbed mattress shell 10 of vinyl, polyethylene, or a similar impervious synthetic plastic. The waterbed mattress shell 10 is similar in length and width as the frame structure of a regular, full, queen or king size waterbed which usually includes a pedestal, a decking board, and upstanding peripheral rails. A sectional view of a typical waterbed frame structure is shown in FIG. 3 where waterbed frame structure has a planar surface decking board 20 and upstanding peripheral rails 22 (one shown). The upstanding peripheral rails 22 are secured to the decking board 20 by mechanical fasteners, such as screws or nails, or by a permanent adhesive. When completed, the decking board 20 and upstanding rails form an open box-like structure with a cavity area. The completed decking board and upstanding rails structure is placed on a pedestal 24 to raise the waterbed from 10 to 24 inches above the floor. The pedestal 24 is usually constructed to have a rectangular frame with an interconnecting grid of supporting slats. The waterbed frame does not form a part of the present invention and the above description is included to emphasize the inventive characteristics of the present invention.

Figure 2:
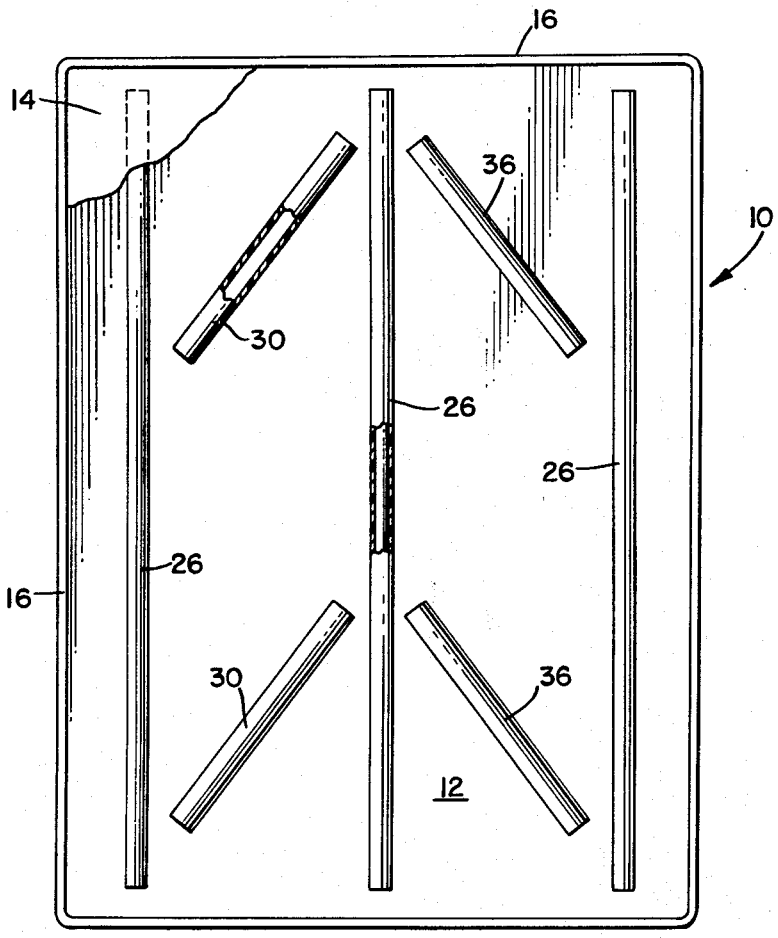
FIG. 2 is a top plan view of a waterbed mattress of the invention.

In FIGS. 1 and 2, the waterbed mattress shell has a bottom wall 12, a top wall 16 and peripheral vertical walls 16. The mattress shell is formed by double heat welding the top and bottom walls to the peripheral vertical walls. The dampening baffles of the invention includes lengthwise baffles 26 and diagonal baffles 30 and 36. The diagonal baffles 30 and 36 are positioned between the lengthwise baffles 26; however, it is possible to position additional diagonal baffles between the peripheral vertical walls 16 and a lengthwise baffle 26.

The baffle arrangement in FIG. 2 shows the diagonal baffles 30 and 36 at an angle of between 35 and 45 degrees to the outside lengthwise baffles. With this arrangement, any water wave action is dampened by striking either the lengthwise baffles 26, the diagonal baffles 30 and 36, or both the lengthwise and diagonal baffles simultaneously. Waves striking the diagonal baffles 30 and 36 force the baffles into contact with the lengthwise baffles 26 forming temporary chambers which trap the waves causing a much faster dampening of the wave action and resonant frequency. Likewise, waves striking the lengthwise baffles 26 force the baffles into contact with diagonal baffles 30 and 36, forming similar temporary chambers with the result that the waves are dampened faster.

A typical baffle dampener of the invention is shown in FIG. 3 in the waterbed mattress shell 10. A baffle dampener 26 in the form of a flexible plastic sheet is shown attached by thermal welds along lower bent edge 28 to the inside lower interior surface of the bottom wall 12 of the waterbed mattress shell 10. The baffle dampener 26 has a floatation rod 32 such as a foamed plastic rod, which is sealed in a pocket formed by wrapping the upper end of the plastic sheet around the rod 32 and thermally sealing along the edge 34. Since the floatation rod 32 floats in water, the baffle dampener 26 will extend the vertical distance between the interior top surface wall 14 and the interior bottom surface wall 12 of the water filled waterbed mattress. The baffle dampener 26 shown in FIG. 3 is separated from the interior inside surface of the top wall 14 to more clearly show the various elements, namely, the baffle dampener 26, the top wall 14, and the bottom wall 12 of the waterbed mattress shell 10. In the preferred embodiment, the baffle dampener 26 is in contact with the interior inside surface of top wall 14 to create a wiping action which has been found to be beneficial in preventing water wave action. Since wave action is created by a person's movement forcing the water transversely across the waterbed mattress, the baffle dampeners 26 achieve substantially complete dampening of the waves when in contact with the interior surface of the top wall 14, as described. This is because as the waves push against the baffle dampeners 26, the dampeners flex in the direction of the wave force at a slow rate due to the floatation rod 32 thereby maintaining a wiping action against the interior surface of top wall 14. If the wave force is great enough there is a momentary slight separation of the baffle dampener 26 from the interior surface of top wall 14; however, the baffle dampener quickly recovers from the separation due to the floatation rod 32 to again form a wiping contact seal against further wave action.

While it is preferred to have a baffle dampener 26 in constant wiping contact with the interior surface of wall 14, wiping contact can be achieved by a person's weight forcing the top wall 14 downward against the baffle dampeners 26; therefore, it is possible to have a slight separation between the baffle dampener 26 and the interior surface of wall 14, as shown in FIG. 3.

Although only one specific form of the waterbed has been described and illustrated in the drawings, it will be understood that various modifications and changes may be made by those skilled in the art without departing from the inventive concept. Reference should therefore be had to the appended claims for a definition of the scope of the invention.

I claim:

1. A waterbed mattress having baffle dampener means for substantially eliminating water wave action comprising:

a top sheet, a bottom sheet, and peripheral vertical walls where said top sheet and said bottom sheet are joined to said perpherial vertical walls on their peripheral edges to form a sealed envelope; and a plurality baffle dampener means in said waterbed mattress, said baffle dampener means being affixed to the interior surface of the bottom sheet and having floatation means for extending said baffle dampener means vertically, said baffle dampener means being positioned in said waterbed mattress to prevent continuous water wave action.

2. A waterbed mattress having baffle dampener means as claimed in claim 1 wherein said waterbed mattress, having a length and a width, and said length is longer than said width.

3. A waterbed mattress having baffle dampener means as claimed in claim 2 wherein at least some of said plurality of baffle dampeners means extend in the lengthwise direction of said waterbed mattress.

4. A waterbed mattress having baffles dampener means as claimed in claim 3 wherein at least some of said plurality of baffle dampeners means are diagonal to said baffle dampener means extending in the lengthwise direction of said waterbed mattress.

5. A waterbed mattress having baffle dampener means as claimed in claim 4 wherein said diagonal baffle dampeners are at angle of about 35–45 degrees to at least one of said baffle dampener means extending in the lengthwise direction of said waterbed mattress.

6. A waterbed mattress having baffle dampener means as claimed in claim 5 wherein said plurality of baffle dampener means maintain a substantially constant wiping contact with the interior of said top wall of said waterbed mattress.

7. A waterbed mattress having baffle dampener means as claimed in claim 1 wherein said waterbed mattress defines a length and a width.

8. A waterbed mattress having baffle dampener means as claimed in claim 7 wherein at least some of said plurality of baffle dampeners means extend in the lengthwise direction of said waterbed mattress.

9. A waterbed mattress having baffles dampener means as claimed in claim 8 wherein at least some of said plurality of baffle dampeners means are diagonal to said baffle dampener means extending in the lengthwise direction of said waterbed mattress.

10. A waterbed mattress having a baffle dampener means as claimed in claim 9 wherein said diagonal baffle dampeners are at angle of about 35–45 degrees to at least one of said baffle dampener means extending in the lengthwise direction of said waterbed mattress.

11. A waterbed mattress having baffle dampener means as claimed in claim 10 wherein said plurality of baffle dampener means maintain a substantially constant wiping contact with the interior of said top wall of said waterbed mattress.

* * * * *